US010767479B2

(12) United States Patent
Magnotti et al.

(10) Patent No.: US 10,767,479 B2
(45) Date of Patent: Sep. 8, 2020

(54) METHOD AND APPARATUS FOR REMOVING PAVEMENT STRUCTURES USING PLASMA BLASTING

(71) Applicant: Petram Technologies, Inc., Cambridge, MA (US)

(72) Inventors: Frank A. Magnotti, Millburn, NJ (US); Igor S. Alexandrov, New York, NY (US)

(73) Assignee: Petram Technologies, Inc., Jersey City, NJ (US)

( * ) Notice: Subject to any disclaimer, the term of this patent is extended or adjusted under 35 U.S.C. 154(b) by 0 days.

(21) Appl. No.: 16/287,016

(22) Filed: Feb. 27, 2019

(65) Prior Publication Data

US 2019/0194882 A1 Jun. 27, 2019

Related U.S. Application Data

(60) Provisional application No. 62/652,076, filed on Apr. 3, 2018.

(51) Int. Cl.
*E21C 37/18* (2006.01)
*F42D 3/04* (2006.01)
(Continued)

(52) U.S. Cl.
CPC ..... *E21C 37/18* (2013.01); *E01C 23/12* (2013.01); *E01C 23/122* (2013.01); *E21B 7/007* (2013.01); *F42D 3/04* (2013.01)

(58) Field of Classification Search
CPC ..... E21C 37/18; F24D 3/04; F42D 3/04
(Continued)

(56) References Cited

U.S. PATENT DOCUMENTS 3,614,163 A * 10/1971 Anderson ..... E01C 23/08 299/14
4,071,095 A * 1/1978 Herron ..... E21B 7/025 173/152

(Continued)

FOREIGN PATENT DOCUMENTS

RU 2144980 C1 1/2000
RU 2184221 C1 6/2002

(Continued)

*Primary Examiner* — Janine M Kreck
*Assistant Examiner* — Michael A Goodwin
(74) *Attorney, Agent, or Firm* — Richard A. Baker, Jr.

(57) ABSTRACT

A method, system and apparatus for plasma blasting pavement comprises an apparatus having a set of diamond cutting tools for creating a boreholes, a diamond saw, and a set of blast probes comprising a high voltage electrode and a ground electrode separated by a dielectric separator, wherein the high voltage electrode and the dielectric separator constitute an adjustable probe tip, and an adjustment unit coupled to the adjustable probe tip, wherein the adjustment unit is configured to selectively extend or retract the adjustable probe tip relative to the ground electrode and a blasting media, wherein at least a portion of the high voltage electrode and the ground electrode are submerged in the blast media. The apparatus saws the pavement at the parameter of the area to be removed, drills holes in the pavement, and inserts blast probes in the holes. The plasma blast breaks up the pavement in between the saw cuts.

14 Claims, 9 Drawing Sheets

(51) Int. Cl.
*E01C 23/12* (2006.01)
*E21B 7/00* (2006.01)

(58) Field of Classification Search
USPC ..... 299/14; 102/301–333
See application file for complete search history.

(56) References Cited

U.S. PATENT DOCUMENTS 4,074,758 A 2/1978 Scott
4,169,503 A 10/1979 Scott
4,345,650 A * 8/1982 Wesley ..... E21B 36/04 166/177.2
4,479,680 A * 10/1984 Wesley ..... E21B 43/26 166/249
4,997,044 A * 3/1991 Stack ..... E21B 17/003 166/177.2
5,106,164 A * 4/1992 Kitzinger ..... E21B 7/007 166/63
5,301,169 A * 4/1994 Baria ..... G01V 1/157 181/106
5,482,357 A * 1/1996 Wint ..... E21C 37/18 299/14
5,573,307 A * 11/1996 Wilkinson ..... E21B 7/15 299/14
6,227,293 B1 5/2001 Huffman et al.
6,283,555 B1 * 9/2001 Arai ..... F42D 3/00 299/14
6,499,536 B1 12/2002 Ellingsen
8,628,146 B2 1/2014 Baltazar-Lopez et al.
9,896,917 B2 2/2018 Sizonenko et al.
2001/0011590 A1 8/2001 Thomas
2010/0270038 A1 10/2010 Looney et al.
2011/0227395 A1 * 9/2011 Baltazar-Lopez ..... E21C 37/18 299/14
2014/0027110 A1 * 1/2014 Ageev ..... E21B 43/24 166/249
2014/0251599 A1 9/2014 Linetskiy
2016/0376752 A1 * 12/2016 Yun ..... E01C 7/147 404/75
2017/0152744 A1 * 6/2017 Mladjan ..... E21C 37/18
2018/0010454 A1 * 1/2018 Holdsworth ..... E21B 7/027
2019/0323811 A1 * 10/2019 Steele ..... F42D 1/00

FOREIGN PATENT DOCUMENTS

RU 2194846 C2 12/2002
RU 2199659 C1 2/2003
RU 2213860 C2 10/2003
RU 2261986 C1 10/2005
RU 2272128 C1 3/2006
RU 2282021 C1 8/2006
RU 2283950 C2 9/2006
RU 2295031 C2 3/2007
RU 2298641 C2 5/2007
RU 2298642 C2 5/2007
RU 2314412 C1 1/2008
RU 2317409 C1 2/2008
RU 2327027 C2 6/2008
RU 2007101698 A 7/2008
RU 2335658 C2 10/2008
RU 2520672 C2 4/2014

* cited by examiner

METHOD AND APPARATUS FOR REMOVING PAVEMENT STRUCTURES USING PLASMA BLASTING

CROSS REFERENCE TO RELATED APPLICATIONS

This provisional application draws from U.S. Pat. No. 8,628,146, filed by Martin Baltazar-Lopez and Steve Best, issued on Jan. 14, 2010, entitled "Method of and apparatus for plasma blasting". The entire patent incorporated herein by reference.

BACKGROUND

Technical Field

The present invention relates to the field of pavement structure removal. More specifically, the present invention relates to the field of plasma blasting to remove pavement structures.

Description of the Related Art

The field of removing pavement structures generally comprises conventional jackhammering. Specifically, whether for mining or civil construction, the pavement structure excavation process generally includes mechanical fracturing and grinding as the primary mechanism for breaking up the pavement. Jackhammering is inefficient, loud, and can cause physical damage to the operator. Mechanical grinding is sometimes used for asphalt, but does not work well for removing concrete surfaces. A better solution to this problem is needed.

An alternate method of surface processing for the excavation of hard rock incorporates the use of electrically powered plasma blasting. In this method, a capacitor bank is charged over a relatively long period of time at a low current, and then discharged in a very short pulse at a very high current into a blasting probe comprised of two or more electrodes immersed in an incompressible fluid media. The fluid media is in direct or indirect contact with the pavement to be fractured.

Previous plasma blasting probes suffered from difficulties in reusability due to the lack of control of the dynamics of the plasma spark. This lack of control also prevented the aiming of the shock waves from the blast into a desired direction.

The present invention, eliminates the issues articulated above as well as other issues with the currently known products.

SUMMARY OF THE INVENTION

A pavement structure removal method is described that first uses two saws to cut two slits in a pavement structure to separate a working area from the rest of the pavement, and then drilling boreholes in the pavement in between the two slits, filling the boreholes with incompressible fluid (water, for example), inserting plasma blast probes in the boreholes, and blasting the pavement using the plasma blast probes. The fractured pavement is then removed using conventional methods, such as grinding, shoveling, or excavating.

A method for fracturing pavement is described herein. The method is made up of the steps of drilling a borehole in the pavement using a drill and removing the drill. The method als includes the steps of inserting a plasma blast probe into the borehole, where the blast probe is designed to focus the blast horizontally and slightly upwards by locating a gap between a plurality of electrodes low in the blast probe, initiating a plasma blast in the plasma blast probe by creating a plasma spark between the electrodes, and removing the plasma blast probe from the borehole.

In some embodiments, the method also include the step of vacuuming pavement debris from the borehole before inserting the plasma blast probe. It could also include the step of flushing pavement debris from the borehole with water before inserting the plasma blast probe. The method could also include cutting the pavement with a saw. In some embodiments, there are a plurality of drills and plasma probes drilling and blasting simultaneously. In some cases the drill and plasma probe are mounted on a platform. The method could also include the steps of moving the platform and repeating the method at a new location. Alternatively, the method could include drilling one borehole and inserting the blast probe in a second borehole simultaneously. In some embodiments, the steps also include filling the borehole with blast media. The plasma blast probe could include a housing in the shape of a cylinder.

An apparatus for fracturing pavement is described below. The apparatus is made up of a platform mounted on a plurality of wheels, where the wheels are in contact with the pavement, a power source, and a drill electrically connected to the power source and mechanically mounted on the platform such that the drill can drill a borehole to and a bottom surface of the pavement. The apparatus also includes a plasma blast probe, mounted on the platform such that the plasma blast probe can be inserted in a borehole to the bottom surface of the pavement, a power storage device, electrically connected to the power source and mechanically mounted on the platform and connected to the plasma blast probe, and a plurality of electrodes mounted inside of the plasma blast probe and electrically connected to the power storage device.

In some embodiments, the drill has a carbide drill bit. The apparatus could also include a saw electrically connected to the power source and mechanically connected to the platform such that the saw can cut the pavement from a top surface to the bottom surface. The saw could have a diamond tipped saw blade. The platform could be attached to a motorized vehicle. The platform could have a plurality of drills and plasma blast probes mounted on it. The apparatus could also include an air compressor electrically connected to the power source and mechanically connected to the platform wherein the air compressor can force compressed air into the borehole. The apparatus could also include a special purpose controller electrically connected to the power source and to the plasma blast probe to control characteristics of the plasma blast. The special purpose controller could be electrically connected to the drill to control a depth of the borehole. The apparatus could also include a pump electrically connected to the power source and mechanically mounted on the platform and controlled by the special purpose controller to pump blast media into the borehole.

DETAILED DESCRIPTION OF THE INVENTION

Figure 1:
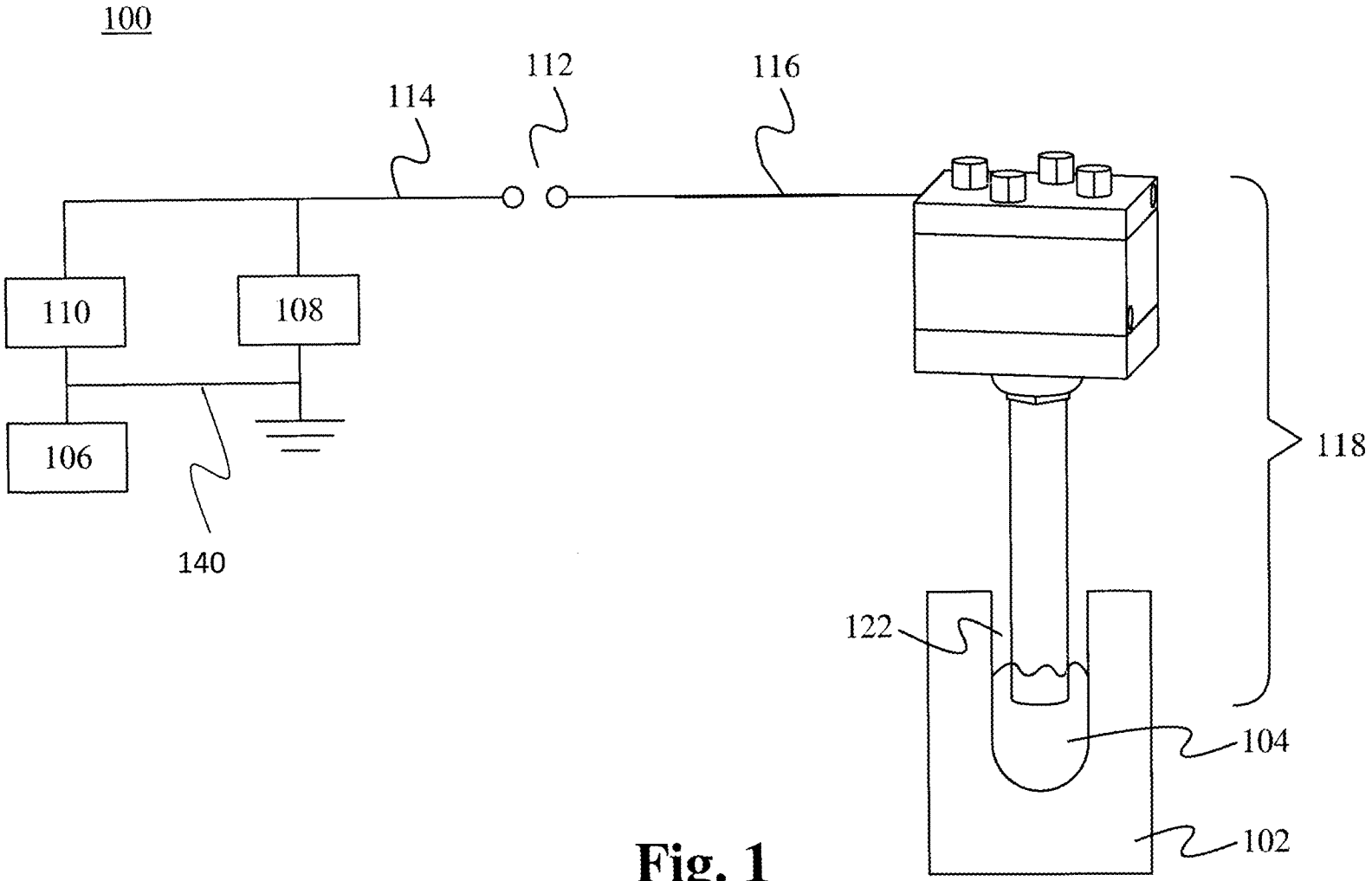
FIG. 1 shows the prior art plasma blasting system in accordance with some embodiments of the Present Application.

FIG. 1 illustrates a plasma blasting system 100 for fracturing a solid 102 in accordance with some embodiments where electrical energy is deposited at a high rate (e.g. a few microseconds), into a blasting media 104 (e.g. an electrolyte or water), wherein this fast discharge in the blasting media 104 creates plasma confined in a borehole 122 within the solid 102. A pressure wave created by the discharge plasma emanates from the blast region thereby fracturing the solid 102.

The Plasma Blasting System

In some embodiments, the plasma blasting system 100 comprises a power supply 106, an electrical storage unit 108, a voltage protection device 110, a high voltage switch 112, a transmission line 114, a cable 116, a blasting probe 118 and a blasting media 104. In some embodiments, the plasma blasting system 100 comprises any number of blasting probes and corresponding blasting media. The power supply 106 comprises any electrical power supply capable of supplying a sufficient voltage to the electrical storage unit 108. The electrical storage unit 108 comprises a capacitor bank or any other suitable electrical storage means. The voltage protection device 110 comprises a crowbar circuit, with voltage-reversal protection means as is well known in the art. The high voltage switch 112 comprises a spark gap, an ignitron, a solid state switch, or any other switch capable of handling high voltages and high currents. In some embodiments, the transmission line 114 and cable 116 comprise a coaxial cable. Alternatively, the transmission line 114 and cable 116 comprises any transmission cable capable of adequately transmitting the pulsed electrical power.

In some embodiments, the power supply 106 couples to the voltage protection device 110 and the electrical storage unit 108 via the power line 140 such that the power supply 106 is able to supply power to the electrical storage unit 108 through the power line 140 and the voltage protection device 110 is able to prevent voltage reversal from harming the system. In some embodiments, the power supply 106, voltage protection device 110 and electric storage unit 108 also couple to the high voltage switch 112 via the transmission line 114 such that the switch 112 is able to receive a specified voltage/current from the electric storage unit 108. The switch 112 then couples to the cable 116 which couples to the blasting probe 118 each that the switch 112 is able to selectively allow the specified voltage/amperage received from the electric storage unit 108 to be transmitted through the line 116 to the blasting probe 118.

Simple Plasma Blasting Probe

Figure 2A:
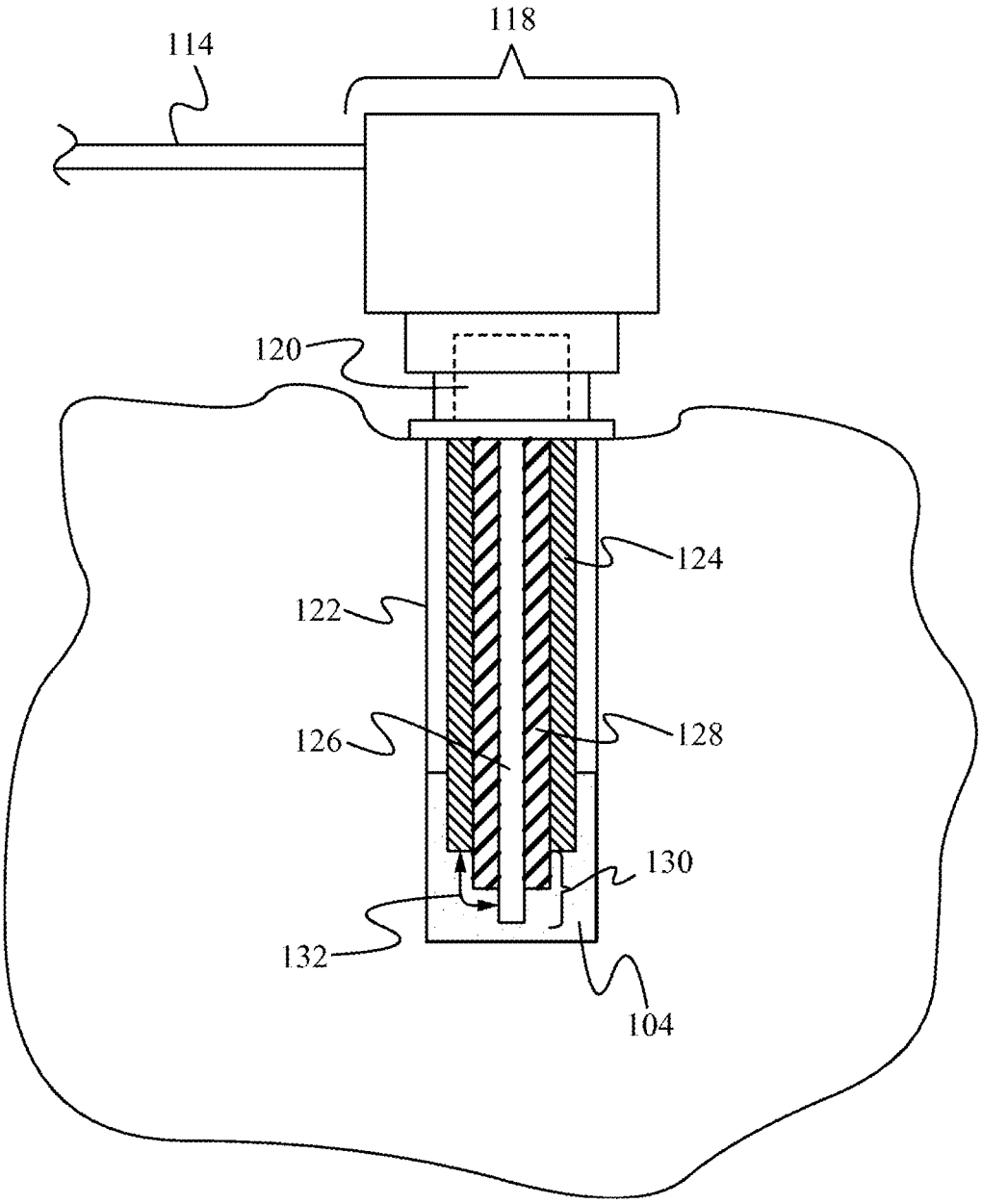
FIG. 2A shows a close up view of the prior art blasting probe in accordance with some embodiments of the Present Application.
Figure 2B:
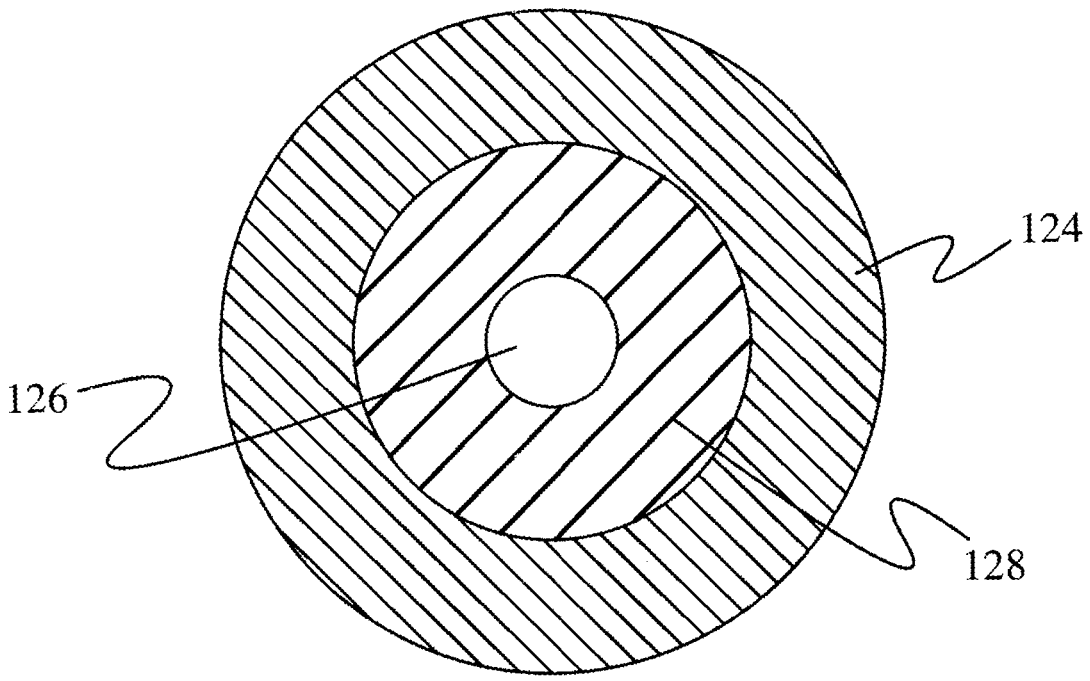
FIG. 2B shows an axial view of the prior art blasting probe in accordance with some embodiments of the Present Application.
Figure 5:
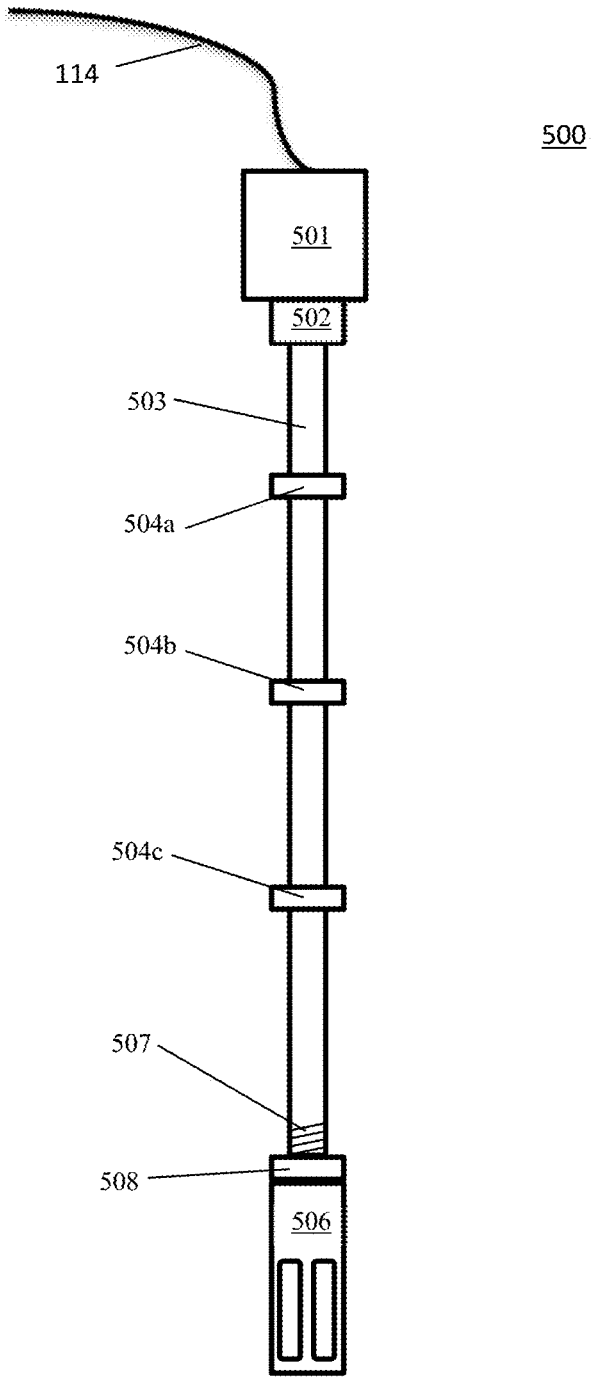
FIG. 5 shows a drawing of the improved probe from the top to the blast tip.
Figure 6:
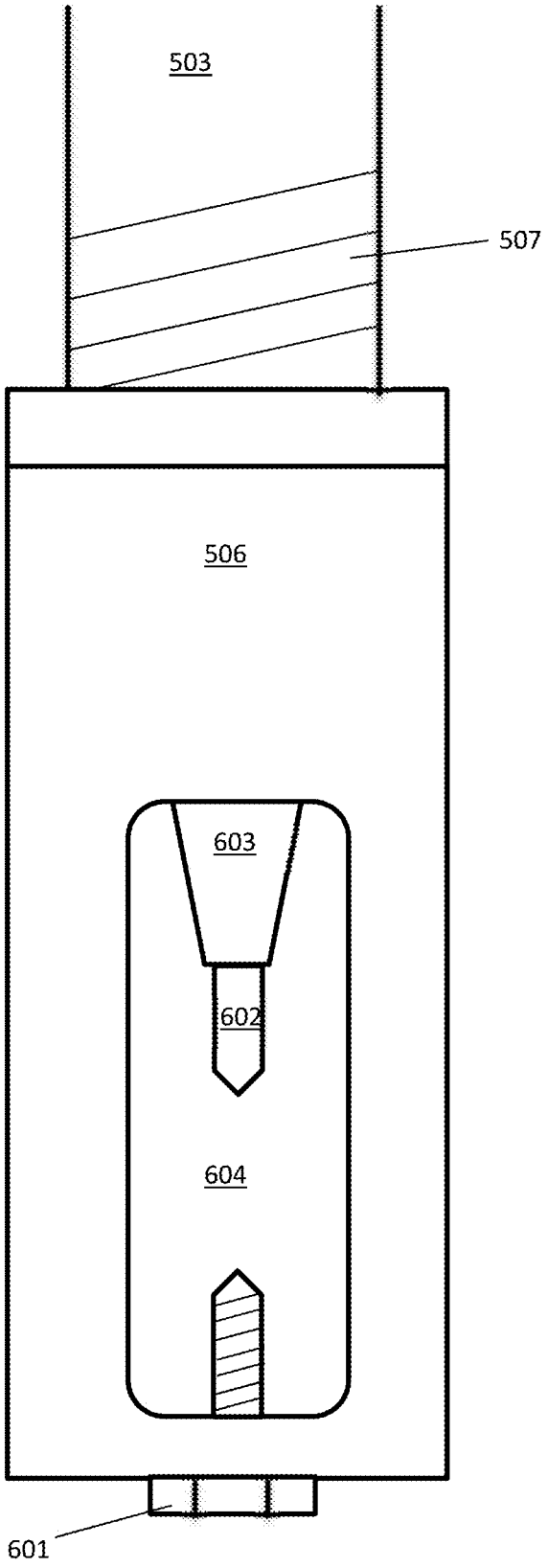
FIG. 6 shows a detailed view into the improved blast tip.

FIG. 2A shows one embodiment for a blasting probe. FIGS. 5 and 6 show another embodiment. As seen in FIG. 2A, the blasting probe 118 comprises an adjustment unit 120, one or more ground electrodes 124, one or more high voltage electrodes 126 and a dielectric separator 128, wherein the end of the high voltage electrode 126 and the dielectric separator 128 constitute an adjustable blasting probe tip 130. The adjustable blasting probe tip 130 is reusable. Specifically, the adjustable blasting probe tip 130 comprises a material and is configured in a geometry such that the force from the blasts will not deform or otherwise harm the tip 130. Alternatively, any number of dielectric separators comprising any number and amount of different dielectric materials are able to be utilized to separate the ground electrode 124 from the high voltage electrode 126. In some embodiments, as shown in FIG. 2B, the high voltage electrode 126 is encircled by the hollow ground electrode 124. Furthermore, in those embodiments the dielectric separator 128 also encircles the high voltage electrode 126 and is used as a buffer between the hollow ground electrode 124 and the high voltage electrode 126 such that the three 124, 126, 128 share an axis and there is no empty space between the high voltage and ground electrodes 124, 126. Alternatively, any other configuration of one or more ground electrodes 124, high voltage electrodes 126 and dielectric separators 128 are able to be used wherein the dielectric separator 128 is positioned between the one or more ground electrodes 124 and the high voltage electrode 126. For example, the configuration shown in FIG. 2B could be switched such that the ground electrode was encircled by the high voltage electrode with the dielectric separator again sandwiched in between, wherein the end of the ground electrode and the dielectric separator would then comprise the adjustable probe tip.

The adjustment unit 120 comprises any suitable probe tip adjustment means as are well known in the art. Further, the adjustment unit 120 couples to the adjustable tip 130 such that the adjustment unit 120 is able to selectively adjust/move the adjustable tip 130 axially away from or towards the end of the ground electrode 124, thereby adjusting the electrode gap 132. In some embodiments, the adjustment unit 120 adjusts/moves the adjustable tip 130 automatically. The term "electrode gap" is defined as the distance between the high voltage and ground electrode 126, 124 through the blasting media 104. Thus, by moving the adjustable tip 130 axially in or out in relation to the end of the ground electrode 124, the adjustment unit 120 is able to adjust the power of the blasting probe 118. As a result, a change in the distance separating the electrodes 124, 126 in the blasting probe 118 is able to be used to vary the electrical power deposited into the solid 102 to be broken or fractured. Accordingly, by allowing more refined control over the electrode gap 132 via the adjustable tip 130, better control over the blasting and breakage yield is able to be obtained.

Figure 3:
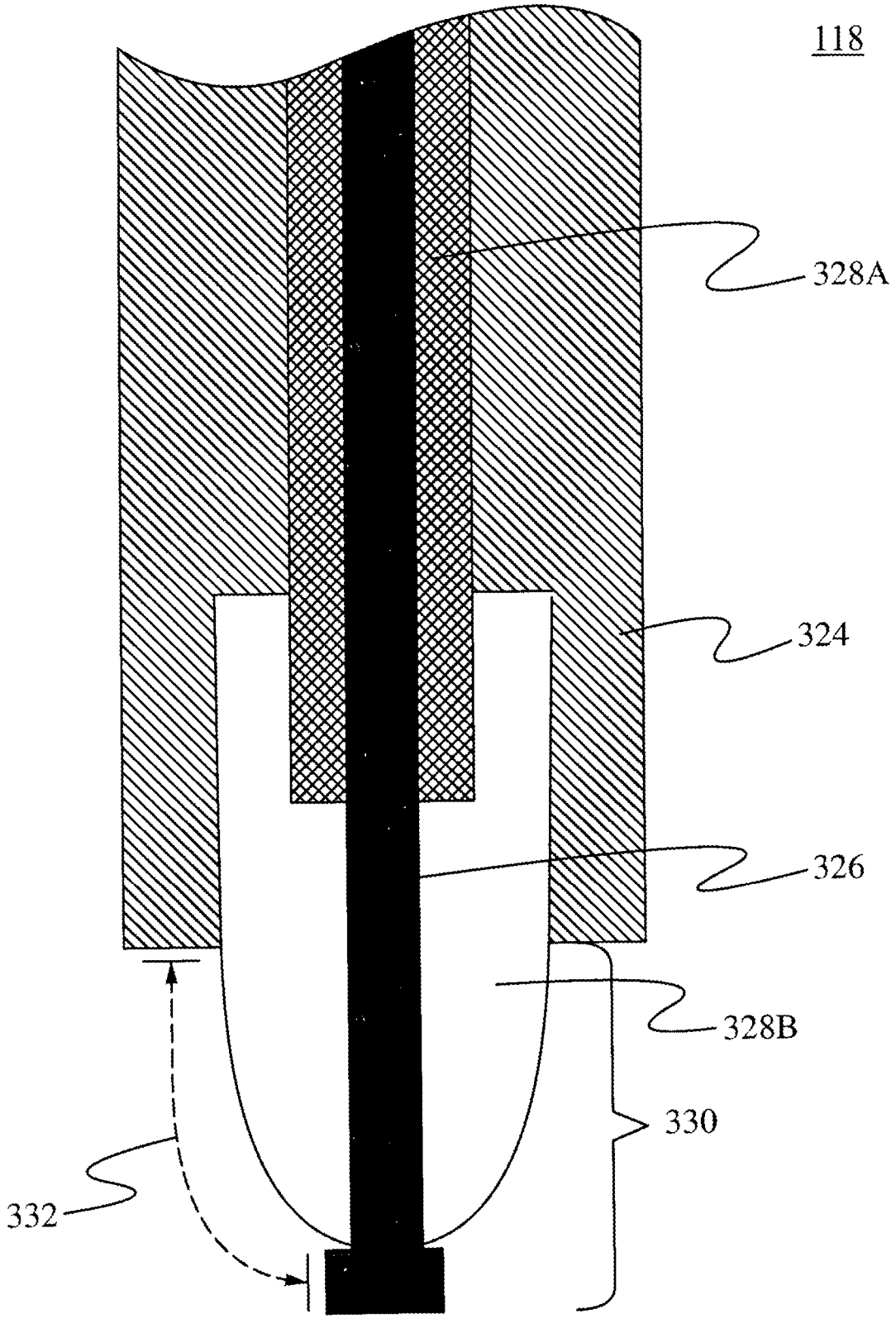
FIG. 3 shows a close up view of the prior art blasting probe comprising two dielectric separators for high energy blasting in accordance with some embodiments of the Present Application.

Another embodiment, as shown in FIG. 3, is substantially similar to the embodiment shown in FIG. 2A except for the differences described herein. As shown in FIG. 3, the blasting probe 118 comprises an adjustment unit (not shown), a ground electrode 324, a high voltage electrode 326, and two different types of dielectric separators, a first dielectric separator 328A and a second dielectric separator 328B. Further, in this embodiment, the adjustable blasting probe tip 330 comprises the end portion of the high voltage electrode 326 and the second dielectric separator 328B. The adjustment unit (not shown) is coupled to the high voltage electrode 326 and the second dielectric separator 328B (via the first dielectric separator 328A), and adjusts/moves the adjustable probe tip 330 axially away from or towards the end of the ground electrode 324, thereby adjusting the electrode gap 332. In some embodiments, the second dielectric separator 328B is a tougher material than the first dielectric separator 328A such that the second dielectric separator 328B better resists structural deformation and is therefore able to better support the adjustable probe tip 330. Similar to the embodiment in FIG. 2A, the first dielectric 328A is encircled by the ground electrode 324 and encircles the high voltage electrode 326 such that all three share a common axis. However, unlike FIG. 2A, towards the end of the high voltage electrode 326, the first dielectric separator 328A is supplanted by a wider second dielectric separator 328B which surrounds the high voltage electrode 326 and forms a conic or parabolic support configuration as illustrated in the FIG. 3. The conic or parabolic support configuration is designed to add further support to the adjustable probe tip 330. Alternatively, any other support configuration could be used to support the adjustable probe tip. Alternatively, the adjustable probe tip 330 is configured to be resistant to deformation. In some embodiments, the second dielectric separator comprises a polycarbonate tip. Alternatively, any other dielectric material is able to be used. In some embodiments, only one dielectric separator is able to be used wherein the single dielectric separator both surrounds the high voltage electrode throughout the blast probe and forms the conic or parabolic support configuration around the adjustable probe tip. In particular, the embodiment shown in FIG. 3 is well suited for higher power blasting, wherein the adjustable blast tip tends to bend and ultimately break. Thus, due to the configuration shown in FIG. 3, the adjustable probe tip 330 is able to be reinforced with the second dielectric material 328B in that the second dielectric material 328B is positioned in a conic or parabolic geometry around the adjustable tip such that the adjustable probe tip 330 is protected from bending due to the blast.

In one embodiment, water is used as the blasting media 104. The water could be poured down the borehole 122 before or after the probe 118 is inserted in the borehole 122. In some embodiments, such as horizontal boreholes 122 or bore holes 122 that extend upward, the blasting media 104 could be contained in a balloon or could be forced under pressure into the borehole 122 with the probe 118.

As shown in FIGS. 1 and 2, the blasting media 104 is positioned within the borehole 122 of the solid 102, with the adjustable tip 130 and at least a portion of the ground electrode 124 suspended within the blasting media 104 within the solid 102. Correspondingly, the blasting media 104 is also in contact with the inner wall of the borehole 122 of the solid 102. The amount of blasting media 104 to be used is dependent on the size of the solid and the size of the blast desired and its calculation is well known in the art.

Figure 4:
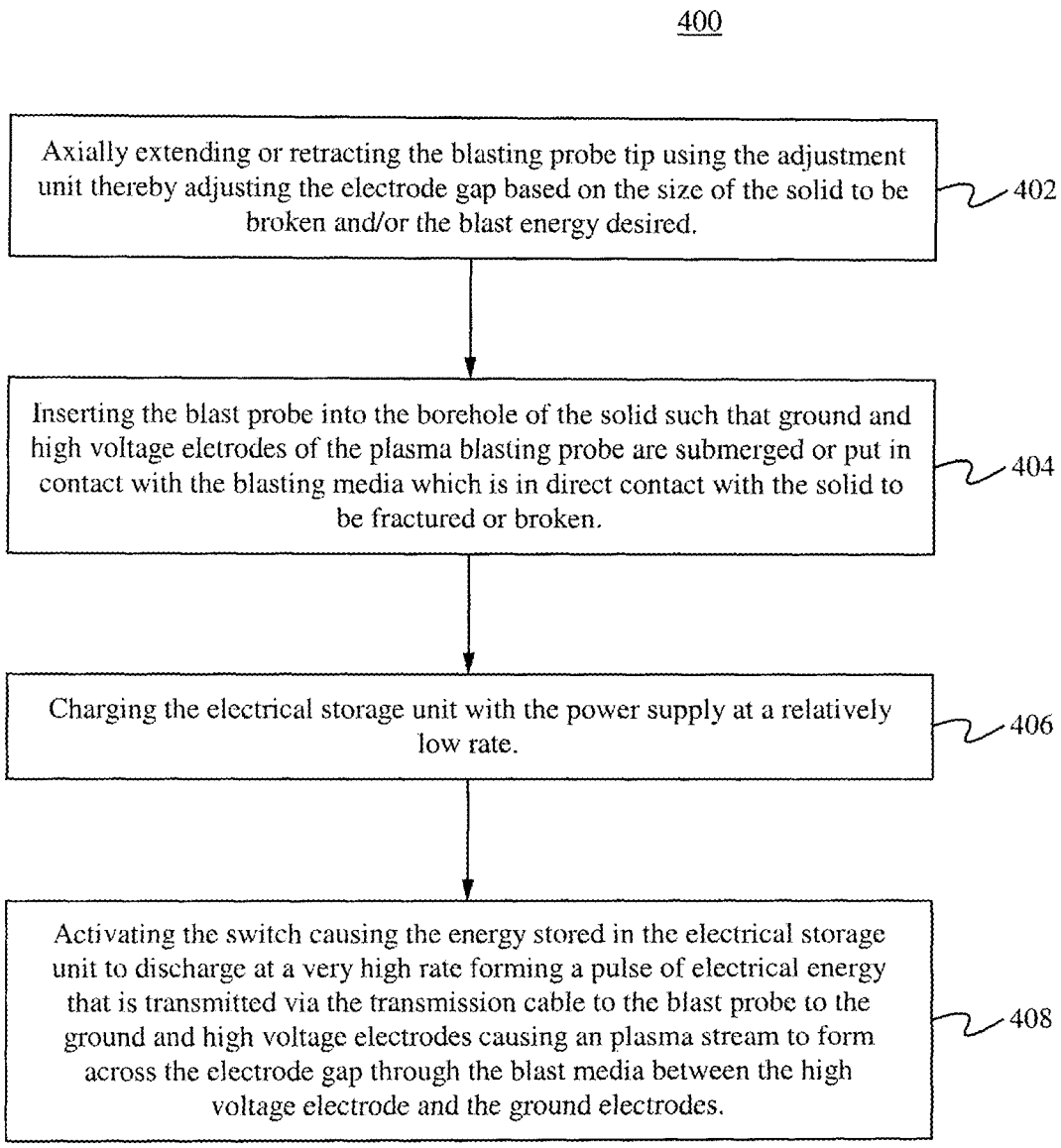
FIG. 4 shows a prior art flow chart illustrating a method of using the plasma blasting system to break or fracture a solid in accordance with some embodiments of the Present Application.

The method and operation 400 of the plasma blasting system 100 will now be discussed in conjunction with a flow chart illustrated in FIG. 4. In operation, as shown in FIGS. 1 and 2, the adjustable tip 130 is axially extended or retracted by the adjustment unit 120 thereby adjusting the electrode gap 132 based on the size of the solid 102 to be broken and/or the blast energy desired at the step 402. The blast probe 118 is then inserted into the borehole 122 of the solid such that at least a portion of the ground and high voltage electrodes 124, 126 of the plasma blasting probe 118 are submerged or put in contact with the blasting media 104 which is in direct contact with the solid 102 to be fractured or broken at the step 404. Alternatively, the electrode gap 132 is able to be adjusted after insertion of the blasting probe 118 into the borehole 122. The electrical storage unit 108 is then charged by the power supply 106 at a relatively low rate of speed (e.g., a few seconds) at the step 406. The switch 112 is then activated causing the energy stored in the electrical storage unit 108 to discharge at a very high rate of speed (e.g. tens of microseconds) forming a pulse of electrical energy (e.g. tens of thousands of Amperes) that is transmitted via the transmission line 114 and cable 116 to the plasma blasting probe 118 to the ground and high voltage electrodes 124, 126 causing a plasma stream to form across the electrode gap 132 through the blast media 104 between the high voltage electrode 126 and the ground electrode 124 at the step 408.

During the first microseconds of the electrical breakdown, the blasting media 104 is subjected to a sudden increase in temperature (e.g. about 5000 to 10,000° C. or more) due to a plasma channel formed between the electrodes 124, 126, which is confined in the borehole 122 and not able to dissipate. The heat generated vaporizes or reacts with part of the blasting media 104, depending on if the blasting media 104 comprises a liquid or a solid respectively, creating a steep pressure rise confined in the borehole 122. Because the discharge is very brief, a blast wave comprising a layer of compressed water vapor (or other vaporized blasting media 104) is formed in front of the vapor containing most of the energy from the discharge. It is this blast wave that then applies force to the inner walls of the borehole 122 and ultimately breaks or fractures the solid 102. Specifically, when the pressure expressed by the wave front (which is able to reach up to 2.5 GPa or more), exceeds the tensile strength of the solid 102, fracture is expected. Thus, the blasting ability depends on the tensile strength of the solid 102 where the plasma blasting probe 118 is placed, and on the intensity of the pressure formed. The plasma blasting system 100 described herein is able to provide pressures well above the tensile strengths of common rocks (e.g. granite=10-20 MPa, tuff=1-4 MPa, and concrete=7 MPa). Thus, the major cause of the fracturing or breaking of the solid 102 is the impact of this compressed water shock wave front which is comparable to one resulting from a high-energy chemical explosive (e.g., dynamite).

As the reaction continues, the blast wave begins propagating outward toward regions with lower atmospheric pressure. As the wave propagates, the pressure of the blast wave front falls with increasing distance. This finally leads to cooling of the gasses and a reversal of flow as a low-pressure region is created behind the wave front, resulting in equilibrium.

If the blasting media 104 comprises a thixotropic fluid as discussed above, when the pulsed discharge vaporizes part of the fluid, the other part rheologically reacts by instantaneously increasing in viscosity, due to being subjected to the force of the vaporized wave front, such that outer part of the fluid acts solid like. This now high viscosity thixotropic fluid thereby seals the borehole 122 where the blasting probe 118 is inserted. Simultaneously, when the plasma blasting system 100 is discharged, and cracks or fractures begin to form in the solid 102, this newly high viscosity thixotropic fluid temporarily seals them thereby allowing for a longer time of confinement of the plasma. Thus, the vapors are prevented from escaping before building up a blast wave with sufficient pressure. This increase in pressure makes the blasting process 400 described herein more efficient, resulting in a more dramatic breakage effect on the solid 102 using the same or less energy compared to traditional plasma blasting techniques when water or other non-thixotropic media are used.

Similarly, if the blasting media 104 comprises an ER fluid as discussed above, when the pulsed discharge vaporizes part of the fluid, a strong electrical field is formed instantaneously increasing the non-vaporized fluid in viscosity such that it acts solid like. Similar to above, this now high viscosity ER fluid thereby seals the borehole 122 where the blasting probe 118 is inserted. Simultaneously, when the plasma blasting system 100 is discharged, and cracks or fractures begin to form in the solid 102, this newly high viscosity ER fluid temporarily seals them thereby allowing for a longer time of confinement of the plasma. Thus, again the vapors are prevented from escaping before building up a blast wave with sufficient pressure.

During testing, the blast probe of the blasting system described herein was inserted into solids comprising either concrete or granite with cast or drilled boreholes having a one inch diameter. A capacitor bank system was used for the electrical storage unit and was charged at a low current and then discharged at a high current via the high voltage switch 112. Peak power achieved was measured in gigawatts. Pulse rise times were around 10-20 μsec and pulse lengths were on the order of 50-100 μsec. The system was able to produce pressures of up to 2.5 GPa and break concrete and granite blocks with masses of more than 850 kg with one discharge.

Advanced Plasma Blasting Probe

FIG. 5 shows an alternative probe 500 embodiment. Probe coupler 501 electrically connects to cable 116 for receiving power from the capacitors 108 and mechanically connects to tethers (could be the cable 116 seen in FIGS. 1 and 7 or other mechanical devices to prevent the probe 500 from departing the borehole 122 after the blast. The probe coupler 501 may incorporate a high voltage coaxial BNC-type high voltage/high current connector to compensate lateral Lorentz' forces on the central electrode and to allow for easy connection of the probe 500 to the wires 114. The mechanical connection may include an eye hook to allow carabiners or wire rope clip to connect to the probe 500. Other mechanical connections could also be used. The probe connection 501 could be made of plastic or metal. The probe connector 501 could be circular in shape and 2 inches in diameter for applications where the probe is inserted in a borehole 122 that is the same depth as the probe 500. In other embodiments, the probe 500 may be inserted in a deep hole, in which case the probe connector 501 must be smaller than the borehole 122.

The probe connector 501 is mechanically connected to the shaft connector 502 with screws, welds, or other mechanical connections. The shaft connector 502 is connected to the probe shaft 503. The connection to the probe shaft 503 could be through male threads on the top of the probe shaft 503 and female threads on the shaft connector 502. Alternately, the shaft connector 502 could include a set screw on through the side to keep the shaft 503 connected to the shaft connector 502. The shaft connector 502 could be a donut shape and made of stainless steel, copper, aluminum, or another conductive material. Electrically, the shaft connector 502 is connected to the ground side of the cable 116. An insulated wire from the probe connector 501 to the high voltage electrode 602 passes through the center of the shaft connector 502. For a 2 inch borehole 122, the shaft connector could be about 1.75 inches in diameter.

The shaft 503 is a hollow shaft that may be threaded 507 at one (or both) ends. The shaft 503 made of stainless steel, copper, aluminum, or another conductive material. Electrically, the shaft 503 is connected to the ground side of the cable 116 through the shaft connector 502. An insulated wire from the probe connector 501 to the high voltage electrode 602 passes through the center of the shaft 503. Mechanically, the shaft 503 is connected to the shaft connector 502 as described above. At the other end, the shaft 503 is connected to the cage 506 through the threaded bolt 508 into the shafts threads 507, or through another mechanical connection (welding, set screws, etc). The shaft 503 may be circular and 1.5 inches in diameter in a 2 inch borehole 122 application. The shaft may be 40 inches long, in one embodiment. At several intervals in the shaft, blast force inhibitors 504*a*, 504*b*, 504*c* may be placed to inhibit the escape of blast wave and the blasting media 104 during the blast. The blast force inhibitors 504*a*, 504*b*, 504*c* may be made of the same material as the shaft 503 and may be welded to the shaft, machined into the shaft, slip fitted onto the shaft or connected with set screws. The inhibitors 504*a*, 504*b*, 504*c* could be shaped as a donut.

The shaft 503 connects to the cage 506 through a threaded bolt 508 that threads into the shaft's threads 507. This allows adjustment of the positioning of the cage 506 and the blast. Other methods of connecting the cage 503 to the shaft 506 could be used without deviating from the invention (for example, a set screw or welding). The cage 506 may be circular and may be 1.75 inches in diameter. The cage 506 may be 4-6 inches long, and may include 4-8 holes 604 in the side to allow the blast to impact the side of the blast hole 122. These holes 604 may be 2-4 inches high and may be 0.5-1 inch wide, with 0.2-0.4 inch pillars in the cage 506 attaching the bottom of the cage 506 to the top. The cage 506 could be made of high strength steel, carbon steel, copper, titanium, tungsten, aluminum, cast iron, or similar materials of sufficient strength to withstand the blast. Electrically, the cage 506 is part of the ground circuit from the shaft 503 to the ground electrode 601.

In an alternative embodiment, a single blast cage could be made of weaker materials, such as plastic, with a wire connected from the shaft to the ground electrode 601 at the bottom of the cage 506.

The details of the cage 506 can be viewed in FIG. 6. A ground electrode 601 is located at the bottom of the cage 506. The ground electrode 601 is made of a conductive material such as steel, aluminum, copper or similar. The ground electrode 601 could be a bolt screwed in female threads at the bottom of the cage 506. Or a nut could be inserted into the bottom of the cage for threading the bolt 601 and securing it to the cage 506. The bolt 601 can be adjusted with washers or nuts on both sides of the cage 506 to allow regulate the gap between the ground electrode bolt 601 and the high voltage electrode 602, depending upon the type of solid 102.

The wire that runs down the shaft 503, as connected to the cable 116 at the probe connector 501, is electrically connected to the high voltage electrode 602. A dielectric separator 603 keeps the electricity from coming in contact with the cage 506. Instead, when the power is applied, a spark is formed between the high voltage electrode 602 and the ground electrode 601. In order to prevent the spark from forming between the high voltage electrode 602 and the cage 506, the distance between the high voltage electrode 602 and the ground electrode 601 must be less than the distance from the high voltage electrode 602 and the cage 506 walls. The two electrodes 601, 602 are on the same axis with the tips opposing each other. If the cage is 1.75 inches in diameter, the cage 506 walls will be about 0.8 inches from the high voltage electrode 602, so the distance between the high voltage electrode 602 and the ground electrode 601 should be less than 0.7 inches. In another embodiment, an insulator could be added inside the cage to prevent sparks between the electrode 602 and the cage when the distance between the high voltage electrode 602 and the ground electrode 601 is larger.

This cage 506 design creates a mostly cylindrical shock wave with the force applied to the sides of the borehole 122. In another embodiment, additional metal or plastic cone-shaped elements may be inserted around lower 601 and upper electrodes 602 to direct a shock wave outside the probe and to reduce axial forces inside the cage.

In one embodiment, a balloon filled with water could be inserted in the cage 506 or the cage 506 could be enclosed in a water filled balloon to keep the water around the electrodes 601, 602 in a horizontal or upside down application.

The method of and apparatus for plasma blasting described herein has numerous advantages. Specifically, by adjusting the blasting probe's tip and thereby the electrode gap, the plasma blasting system is able to provide better control over the power deposited into the specimen to be broken. Consequently, the power used is able to be adjusted according to the size and tensile strength of the solid to be broken instead of using the same amount of power regardless of the solid to be broken. Furthermore, the system efficiency is also increased by using a thixotropic or reactive materials (RM) blasting media in the plasma blasting system. Specifically, the thixotropic or RM properties of the blasting media maximize the amount of force applied to the solid relative to the energy input into the system by not allowing the energy to easily escape the borehole as described above and to add energy from the RM reaction. Moreover, because the thixotropic or RM blasting media is inert, it is safer than the use of combustible chemicals and/or explosives. As a result, the plasma blasting system is more efficient in terms of energy, safer in terms of its inert qualities, and requires smaller components thereby dramatically decreasing the cost of operation.

Accordingly, for the mining and civil construction industries this will represent more volume of rock breakage per blast at lower cost with better control. For the public works construction around populated areas this represents less vibration, reduced noise and little to no flying rock produced. For the space exploration industry where chemical explosives are a big concern, the use of this inert blasting media is an excellent alternative. Overall, the method of and apparatus for plasma blasting described herein provides an effective reduction in cost per blast and a higher volume breakage yield of a solid substance while being safe, environmentally friendly and providing better control.

Pavement Removal

The above plasma blasting probes can be very useful in the removal of pavement, especially rigid pavement such as Portland cement concrete. Because the concrete is rigid and hard, it is difficult to break using traditional methods such as jackhammers or grinding machines. Grinding machines are often used for flexible pavement such as hot mix asphalt, but the grinding machines are less effective with rigid pavement. Jackhammers are often used to break up the rigid concrete, but this is labor intensive, and can be harmful to the workers. Another method for the removal of pavement is to cut the concrete into large blocks that are lifted intact into trucks for removal. But block removal does not work if the concrete has deteriorated. Furthermore, block removal leaves huge blocks of concrete that need to be broken up at a later time.

Figure 7:
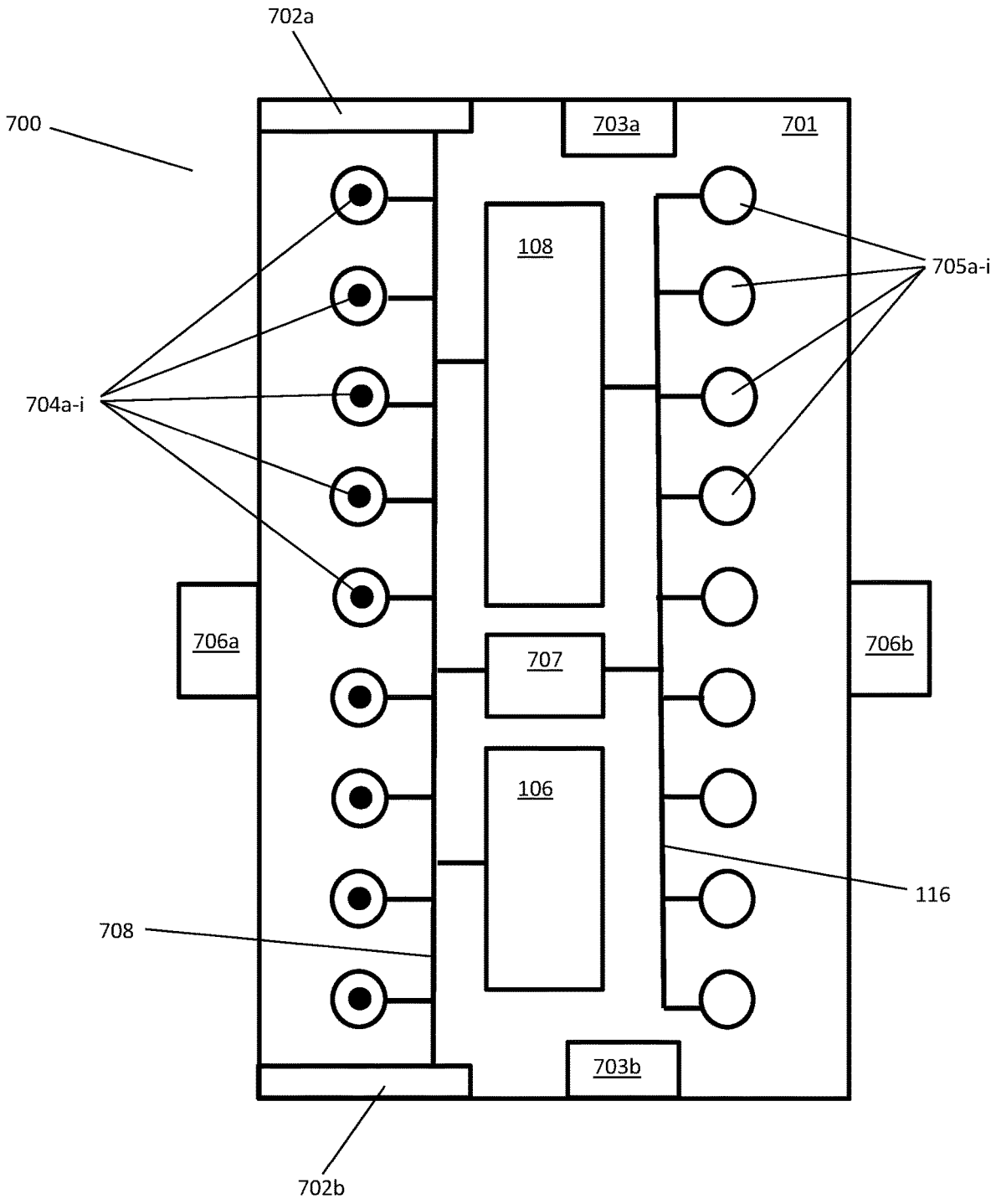
FIG. 7 illustrates an apparatus for removing pavement using drills and plasma blasting bits.

FIG. 7 illustrates a pavement removal apparatus 700. The apparatus 700 is built on a platform 701 that could be connected to a truck or a tractor via a hitch 706*a*, 706*b*. The hitch 706*a*, 706*b* could be connected to the front or back of the apparatus 700. Using the front hitch 706*a* has the advantage of allowing the truck or tractor to drive on the existing pavement, allowing for faster and smoother operation. Using the rear hitch 706*b* allows the apparatus 700 to be operated close to barriers, such as walls and confined areas. The hitch 706*a*, 706*b* could be a three-point hitch, a trailer hitch, a plow hitch, or a tractor bucket attachment (or similar) to the truck or tractor. In the preferred embodiment, the truck or tractor is able to lift the apparatus 700. Ideally, the hitch 706*a*, 706*b* has the capability to maneuver the apparatus 700 with precision, keeping the apparatus 700 level even when the pavement is uneven.

The platform 701 could be the width of a lane of road for applications where the pavement is on a roadway. However, other sizes could be used without departing from the invention.

In one embodiment, the platform 701 is mounted on two wheels 703*a*, 703*b*. This allows the hitch 706*a*, 706*b* to maintain level over various surface conditions. It also allows the hitch 706*a*, 706*b* to vary the level of the saws 702*a*, 702*b*. In another embodiment, the apparatus 700 is mounted on four (or more) wheels. This embodiment could include a leveling apparatuses on the platform 701 to assure that the platform 701 is level. This embodiment might include accelerometers at the corners of the platform 701 and a controller to direct the leveling apparatuses.

The platform 701 may have saws 702*a*, 702*b* on either side for cutting the pavement at the edge of the area to cut. In another embodiment, the saws 702*a*, 702*b* could be mounted of such that the saws 702*a*, 702*b* could be moved to any distance apart, perhaps by mounting the saws 702*a*, 702*b* on the front of the platform 701 on a rail. Saws 702*a*, 702*b* could be diamond saws, carbide saws, of any other type of saw suitable for cutting pavement. In many embodiments, water is used to cool the saws 702*a*, 702*b* and to minimize the dust from the cutting. The saws 702*a*, 702*b* are powered by the power source 106 through the wire harness 708.

The platform 701 also has a variable number of drills 704*a-i* mounted on the platform. These drills receive their power from the power source 106 through a wiring harness 708. In some embodiments, each drill can be turned on or off separately so that any width of pavement can be removed. For instance, in the moveable saw embodiment above, the saws 702*a*, 702*b* could be moved in and four drills 704*a-i* activated to use the apparatus 700 to remove a smaller section of pavement. The drills 704*a-i* could be located 1 foot apart in some embodiments and could drill 1 inch holes. The holes could be drilled about 60% of the way into the pavement. The drills 704*a-i* could be diamond tipped drills, carbide tipped, or other material suitable for drilling pavement. The drills 704*a-i* could create a core for removal or could break up the material as it drills. In many embodiments, water is used to cool the drills 704*a-i* and to minimize the dust from the drilling.

In addition to powering the drills and the saws, the power source 106 supplies power to the power storage device 108 through the wire harness 708.

There are also a various number of plasma blast probes 705*a-i* mounted on the platform, one each behind and in line with the drills 704*a-i*. After the drills 704*a-i* create the boreholes in the pavement, the platform is moved forward and the plasma blast probes 705*a-i* are inserted in the boreholes. The energy stored in the power storage device 108 is then discharged through the cable 116 into the probes to create a plasma blast in the borehole, breaking up the pavement. The plasma blast probes 705*a-i* are described above, although the design may be modified to maximize the blast waves in a symmetrical, horizontal direction. The distance between the drills and the plasma blast probes could be 1 foot in some embodiments.

In many applications, the energy from the blast needs to be focused on the horizontal directions, and the forces going down minimized. This could be done by designing the probe 500, 705*a-i* to create the plasma blast low in the cage 506 by making the gap in between the electrodes 601,602 low in the cage 506. The cage 506 then protects the surface below the probes 500, 705*a-i* and focuses the energy horizontally and slightly upward. Alternately, a metal cone could be placed at the bottom of the borehole to reflect the shock waves going downward back up.

The apparatus 700 could vary the depths of the boreholes, the width of the boreholes, the distance between the boreholes, the distance between the drills 704*a-i* and the probes 705*a-i*, the energy used in the blasts, and the distance between the electrodes 601,602 to manage the precision of the pavement removal and to account for various strengths and characteristics of the pavement. Typically, the pavement is about 12 inches thick, and care must be taken not to damage the compacted gravel underside of the concrete roadway. Other applications could consist of airport runways or bridge decking.

In one embodiment, the drills 704*a-i* and the probes 705*a-i* could be mounted on such that when the drills 704*a-i* finish drilling, they are removed from the boreholes and the probes 705*a-i* are inserted and blast before the platform 701 moves.

In another embodiment, the drills 704*a-i* and probes 705*a-i* are mounted such that the boreholes are drilled horizontally into the side pavement. The cage 506 on the probes 705*a-i* could be designed to focus the blast up and to the sides, protecting the under-pavement and loosening the pavement above the horizontal borehole.

In still another embodiment, the drill bits could be designed to also incorporate a plasma blast probe, so that the drilling and blasting are performed without removing the drill bit/blast probe. In this embodiment, the drill bit is on the bottom of the probe, and cuts the pavement until the blast probe is at the proper depth. Then the probe initiates the plasma blast. To prevent the drilling debris from blocking the electrodes, a plastic sleeve may need to surround the blast chamber. Alternatively, a suction mechanism could be used to remove the drilling debris.

In one embodiment, the functionality of the drills 704*a-i* could be combined with the plasma blast probe 705*a-i*. In this embodiment, the probe shown in FIG. 6 would be modified to mount a drill and bit below the lower electrode 601. The drill would drill the hole, breaking up the material as if proceeds. The material could be removed via vacuum or via circulating water or compressed air. When the borehole is drilled such that the plasma blast cage 506 is at the proper depth, the drill stops and a plasma blast is initiated to break the pavement. An additional step to clean the probe by flushing the electrodes may be needed. In this embodiment, there is no need for a second row of plasma blast probes 705*a-i* although the line of drill/probe devices should be moved behind the saws 702*a*, 702*b* so that the blast does not create cracking beyond the intended area for removal.

A special purpose controller 707 is also located on the platform 701. The special purpose controller 707 is shielded to protect the controller from electrical, magnetic, and mechanical interference from the plasma blasts. The controller 707 could include a special purpose microprocessor, memory, a mass storage device (hard disk, CD or solid state drive), IO interfaces to the probes 705*a-i* and the drills 704*a-i*, power conditioning equipment, a Bluetooth interface, a network interfaces (could be WiFi, Cellular, wired Ethernet, or similar).

The controller 707 could operate algorithms to control the separation of the electrodes in the probe 705*a-i* and the amount of energy (varying voltages and/or the number of capacitors) sent to the probe to create the spark/plasma blast. In addition, the controller 707 could control length of time that the spark is present and the timing of one or more plasma blasts if multiple blasts are desired. By controlling these factors the characteristics of the plasma blast can be controlled with precision. In addition, the controller 707 could determine how deep the drills make the boreholes and the depth where plasma blast probe is located when the blast is initiated.

Figure 8:
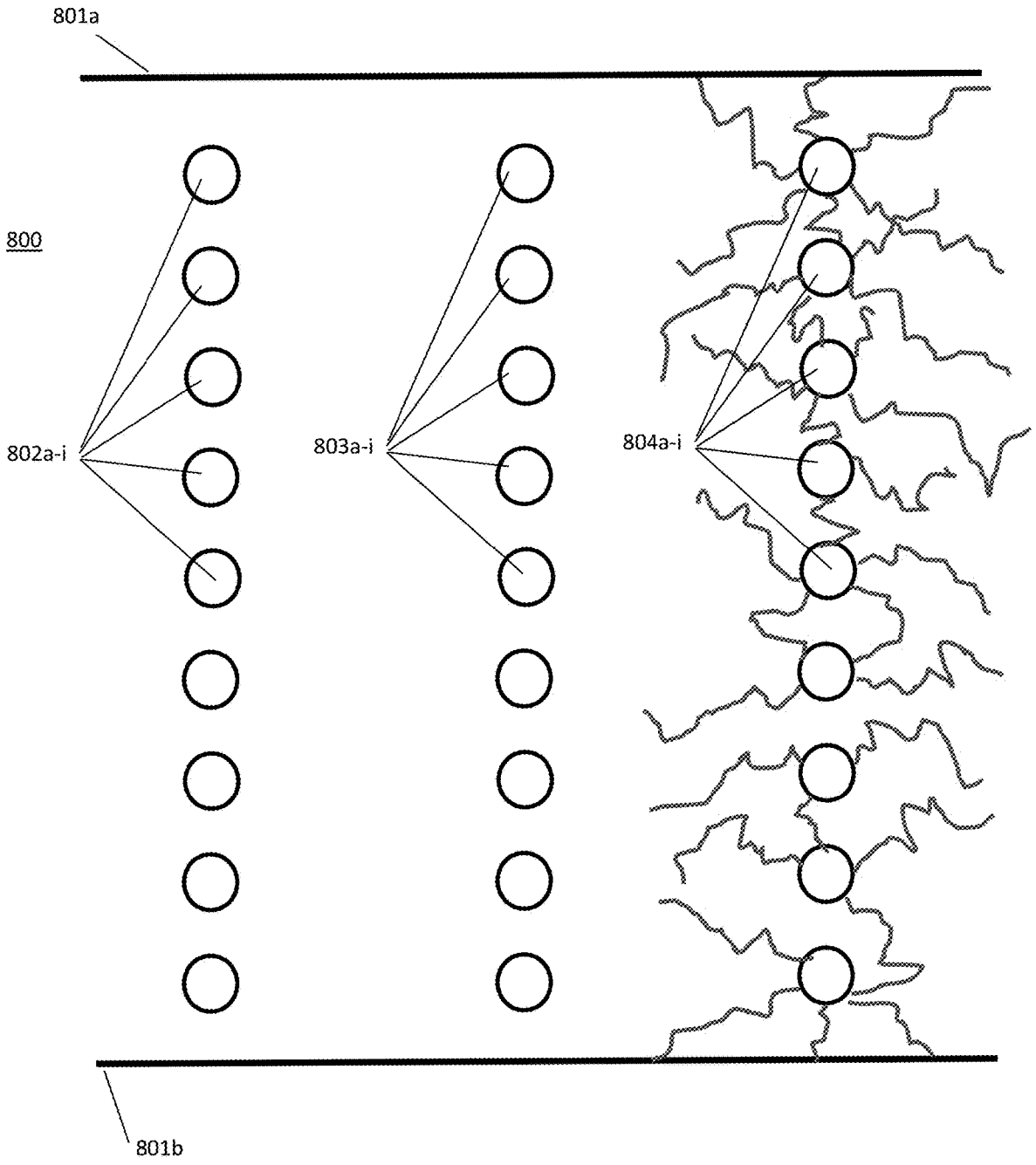
FIG. 8 shows the progression of the pavement removal.

FIG. 8 shows the progression of the apparatus 700 across pavement 800. The pavement is cut with two slits 801*a*, 802*b* created by the saws 702*a*, 702*b*. As the saws 702*a*, 702*b* cut through the pavement on the edges, the drills 704*a-i* create the boreholes 802*a-i*. Once the boreholes 802*a-i* are drilled, the apparatus 700 move forward one foot (or the distance between the drills 704*a-i* and the probes 705*a-i*) while the saws 702*a*, 702*b* continue to lengthen the slits 801*a*, 801*b*. The probes 705*a-i* are then inserted in the boreholes 803*a-i* and the plasma blasts are initiated, creating broken pavement 804*a-i*. Meanwhile, the drills 7041-*i* beginning drilling a new set of boreholes 802*a-i*. Once the pavement is broken 804*a-i*, any number of techniques can be used to remove the cracked and broken pavement. For instance, a skid steer could be used to collect the broken pavement in its bucket or men could be used to shovel the pavement out of the road. Automated bucket devices could scoop up the broken pavement and put it on a transfer line for delivery to a dump truck.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A method for fracturing pavement, the method comprising:

drilling a borehole in the pavement using a drill;

removing the drill;

inserting a directional plasma blast probe into the borehole, where the blast probe focuses a blast horizontally and upwards by locating a gap between a plurality of electrodes enclosed in a cylindrical cage below a center point of one or more openings in the cylindrical cage of the blast probe;

initiating a plasma blast in the plasma blast probe by creating a plasma spark between the electrodes, the plasma blast fracturing the pavement;

removing the plasma blast probe from the borehole.

2. The method of claim 1 further comprising vacuuming pavement debris from the borehole before inserting the plasma blast probe.

3. The method of claim 1 further comprising flushing pavement debris from the borehole with water before inserting the plasma blast probe.

4. The method of claim 1 further comprising cutting the pavement with a saw.

5. The method of claim 1 wherein a plurality of drills drill simultaneously and a plurality of plasma blast probes blast simultaneously.

6. The method of claim 1 wherein the drill and plasma probe are mounted on a platform.

7. The method of claim 6 further comprising moving the platform; and repeating the method at a new location.

8. The method of claim 6 further comprising drilling one borehole and inserting the blast probe in a second borehole simultaneously.

9. The method of claim 1 further comprising filling the borehole with blast media.

10. An apparatus for fracturing pavement, the apparatus comprising:

a platform mounted on a plurality of wheels, where the wheels are in contact with the pavement;

a power source;

a plurality of pavement drills electrically connected to the power source and mechanically mounted on the platform such that each of the plurality of the pavement drills can drill a borehole to a bottom surface of the pavement;

a plurality of plasma blast probes, mounted on the platform such that each of the plurality of the plasma blast probes can be inserted in the borehole to the bottom surface of the pavement, the plasma blast probes comprising a plurality of electrodes in a cylindrical cage, wherein the plurality of the electrodes have a gap located below a center point of one or more openings in the cylindrical cage;

a power storage device, electrically connected to the power source and mechanically mounted on the platform and connected to the plurality of the plasma blast probes;

the plurality of electrodes mounted inside of each of the plurality of the plasma blast probes and electrically connected to the power storage device.

11. The apparatus of claim 10 further comprising a saw electrically connected to the power source and mechanically connected to the platform such that the saw can cut the pavement from a top surface to the bottom surface.

12. The apparatus of claim 11 wherein the saw has a diamond tipped saw blade.

13. The apparatus of claim 10 further comprising a special purpose controller electrically connected to the power source and to the plurality of plasma blast probes to control characteristics of the plasma blast.

14. The apparatus of claim 13 wherein the special purpose controller is electrically connected to each of the plurality of pavement drills to control a depth of the borehole.

* * * * *